United States Patent [19]

Taki

[11] Patent Number: 5,013,185

[45] Date of Patent: May 7, 1991

[54] MULTI-SHAFT AUGER APPARATUS AND PROCESS FOR FIXATION OF SOILS CONTAINING TOXIC WASTES

[76] Inventor: Osamu Taki, 2558 Somerset Dr., Belmont, Calif. 94002

[21] Appl. No.: 172,286

[22] Filed: Mar. 23, 1988

Related U.S. Application Data

[63] Continuation-in-part of Ser. No. 172,401, Mar. 23, 1988, Pat. No. 4,886,400.

[51] Int. Cl.[5] ..... E02D 3/12

[52] U.S. Cl. ..... 405/128; 405/266; 405/269

[58] Field of Search ..... 405/128, 129, 263, 266, 405/269, 233, 258, 267; 175/323, 394

[56] References Cited

U.S. PATENT DOCUMENTS

| | | | |
|---|---|---|---|
| 4,043,909 | 8/1977 | Endo et al. | 210/49 |
| 4,063,424 | 12/1977 | Takagi et al. | 61/63 |
| 4,065,928 | 1/1978 | Takagi et al. | 61/36 R |
| 4,065,933 | 1/1978 | Katayama | 61/50 |
| 4,069,678 | 1/1978 | Miura et al. | 61/63 |
| 4,084,383 | 4/1978 | Kukino et al. | 61/36 R |
| 4,089,183 | 5/1978 | Endo et al. | 61/50 |
| 4,189,239 | 2/1980 | Miyaguchi et al. | 366/169 |
| 4,212,548 | 7/1980 | Miyaguchi et al. | 366/348 |
| 4,402,630 | 10/1983 | Miura et al. | 405/266 |
| 4,436,453 | 3/1984 | Miura et al. | 405/263 |
| 4,449,856 | 5/1984 | Tokoro et al. | 405/269 |
| 4,475,847 | 10/1984 | Cornely et al. | 405/264 |

FOREIGN PATENT DOCUMENTS

| | | |
|---|---|---|
| 51-71605 | 6/1976 | Japan . |
| 52-78302 | 6/1977 | Japan . |
| 52-152608 | 12/1977 | Japan . |
| 55-44812 | 11/1980 | Japan . |
| 58-29374 | 6/1983 | Japan . |
| 58-29375 | 6/1983 | Japan . |

OTHER PUBLICATIONS

"S.M.W. Machine," Product Brochure of S.M.W. Seiko, Inc.

"Teno Column Method" Product Brochure of the Tenox Corporation (Publication Date Unknown).

"Just One of Our Fleet," Product Advertisement (Publication Date Unknown).

"The Soil Mixing Wall (SMW Technique)-Guidelines for its Design and Implementation," Japanese Materials Institute.

"In Situ Soil Improvement Techniques, Lime Columns" (Dated Mar. 1987).

Jasperse and Ryan, "Geotech Import: Deep Soil Mixing," Civil Engineering (Dec. 1987), pp. 66-68.

*Primary Examiner*—David H. Corbin

*Attorney, Agent, or Firm*—Workman, Nydegger & Jensen

[57] ABSTRACT

The present invention is directed to a modified multi-shaft auger apparatus for in situ fixation of soil contaminated with toxic waste. Soil fixation is achieved by augering a plurality of boreholes downwardly into the contaminated soil with a modified multi-shaft auger machine. A chemical hardener is injected into the contaminated soil while the boreholes are being augered. As the shafts rotate, a plurality of soil mixing paddles extending outwardly from each shaft blend the contaminated soil with the chemical hardener in situ. The soil mixing paddles are configured so as to minimize the vertical movement of the contaminated soil out of the boreholes in order to maximize in situ containment of the contaminated soil. Upon hardening, the soil is immobilized such that hazardous chemicals, toxic compounds and other soil constituents are trapped in order to prevent migration from the fixated area.

A multi-shaft auger apparatus capable of augering boreholes of different diameter is disclosed. Boreholes of different diameter are arranged in a pattern which efficiently eliminates interstitial spaces between adjacent boreholes. As a result, a larger area of contaminated soil may be fixated according to the methods of the present invention more efficiently than by use of boreholes having substantially equal diameter.

To achieve maximum horizontal blending of the contaminated soil with the chemical hardener, various soil mixing paddle configurations are disclosed. The present invention contemplates the use of different soil mixing paddle configurations depending upon the existing soil conditions.

56 Claims, 7 Drawing Sheets

MULTI-SHAFT AUGER APPARATUS AND PROCESS FOR FIXATION OF SOILS CONTAINING TOXIC WASTES

RELATED APPLICATION

The present invention is a continuation-in-part of copending U.S. patent application Ser. No. 07/172,401, filed Mar. 23, 1988, now U.S. Pat. No. 4,886,400, in the names of Osamu Taki and Shigeru Takeshima, and entitled "SIDE CUTTING BLADES FOR MULTI-SHAFT AUGER SYSTEM AND IMPROVED SOIL MIXING WALL FORMATION PROCESS," which patent application is incorporated herein by specific reference.

Background

1. The Field of the Invention

The present invention relates to processes for fixation of soil contaminated with toxic or hazardous waste and to improved multi-shaft auger systems for performing such processes. More particularly, the present invention permits in situ blending of contaminated soil with a chemical hardener in such a way that the contaminants are immobilized in situ so that they will not migrate to uncontaminated surrounding soil.

2. The Prior Art

In recent years, the public has become more sensitive to the environment and the effect industry is having on the environmental ecosystem. In particular, the public has recognized the need and desirability of being free from exposure to toxic wastes and other hazardous chemicals and chemical by-products.

One of the most serious exposure to toxic chemicals occurs when the ground water of a community becomes contaminated. Ground water contamination not only effects the health and safety of humans, but also other forms of plant and animal life. Ground water contamination can result from direct introduction of harmful chemicals into the water source. In such cases, the source of contamination is a manufacturer which dumps the toxic waste directly into the water supply. Once the source of contamination is identified, the problem can usually be remedied by preventing future dumping of the harmful contaminants or by requiring the use of adequate waste treatment techniques.

A more difficult problem occurs when the water supply becomes contaminated through harmful chemicals which enter and migrate through the soil, thereby contaminating the water supply. Generally, when soil becomes contaminated, the only solution is to physically remove the contaminated soil or to construct barriers to prevent the migration or further spread of the contaminants.

Removal is the usual treatment for soil contaminated with toxic or hazardous wastes. Typically, the soil is excavated and removed to a remote toxic waste depository. Often, the soil is sealed in waste receptacles. The waste receptacles are then placed in abandoned mines or deep caves, or sometimes, the waste receptacles are buried at sea.

Unfortunately, physical removal of contaminated soil is expensive and time-consuming. Moreover, physical removal of contaminated soil exposes the construction workers (and sometimes the adjacent community) to the contaminants. In addition, physical removal of contaminated soil only shifts the problem to another location. Over time, physical removal may be only an interim.

An alternative technique used in treating soil contaminated with toxic wastes is the construction of barrier walls in the soil to surround or encapsulate the soil. Barrier walls are also expensive and time-consuming to construct. In addition, the barrier walls, usually constructed of concrete, tend to crack from earth movement (such as an earthquake or soil settling). Cracks in the barrier walls then allow the toxic wastes to escape.

From the foregoing, it will be appreciated that what is needed in the art are apparatus and methods for fixation of soil contaminated with toxic wastes which avoids the expense and time-consuming process of physically removing the contaminated soil from the contamination site.

It would be a further advancement in the art to provide apparatus and methods for fixation of soil contaminated with toxic wastes which do not expose construction workers to the contaminants.

It would be another advancement in the art to provide apparatus and methods for fixation of soil contaminated with toxic waste which eliminates the risk of the contaminants migrating into the surrounding water supply.

Additionally, it would be a significant advancement in the art to provide apparatus and methods for fixation of soil contaminated with toxic waste which immobilizes the soil such that hazardous chemicals, compounds, or other constituents are trapped from escaping the fixated area.

It would be yet another advancement in the art to provide apparatus and methods for fixation of soil contaminated with toxic waste which do not enlarge the area of contamination.

The foregoing, and other features and objects of the present invention are realized in the improved multi-shaft auger apparatus and methods for fixation of soil contaminated with toxic wastes which are disclosed and claimed herein.

BRIEF SUMMARY AND OBJECTS OF THE INVENTION

The present invention is directed to a modified multi-shaft auger apparatus for in situ fixation of soil contaminated with toxic waste. The present invention applies unrelated technology for in situ construction of columns and walls to solve the problems associated with treatment of contaminated soil.

According to the present invention, soil fixation is achieved by augering a plurality of boreholes downwardly into the contaminated soil with a modified multi-shaft auger machine. A chemical hardener is injected into the contaminated soil while the boreholes are being augered.

As the shafts rotate, a plurality of soil mixing paddles extending outwardly from each shaft blend the contaminated soil with the chemical hardener in situ. The soil mixing paddles are configured so as to minimize the vertical movement of the contaminated soil out of the boreholes in order to maximize in situ containment of the contaminated soil.

The multi-shaft auger apparatus is withdrawn from the contaminated soil and moved to a position adjacent the previously augered boreholes. Additional boreholes are then augered and the process repeated until the entire area of contaminated soil is treated. The boreholes are arranged in a configuration which minimizes the interstitial spaces between adjacent boreholes. This is accomplished by overlapping and/or offsetting the boreholes.

Existing multi-shaft auger machines are modified according to the present invention to accomplish the unique purpose of fixation of contaminated soil. Existing multi-shaft auger machines are generally adapted for augering boreholes deep into the ground. As a result, each shaft of the multi-shaft auger apparatus contains a plurality of augers and soil mixing paddles intermittently spaced along the length of the shaft to achieve both vertical and horizontal mixing of the soil with the chemical hardener.

Because contaminated soil generally does not extend to a great depth (greater than ten meters) existing multi-shaft auger machines are modified for use in shallow soil conditions. In addition, the existing multi-shaft auger machines are modified to maximize the horizontal blending of soil with the chemical hardener while minimizing the vertical movement of the contaminated soil out of the boreholes. In this way, in situ containment of the contaminated soil is maximized.

To achieve maximum horizontal blending of the contaminated soil with the chemical hardener, various soil mixing paddle configurations are disclosed. The present invention contemplates the use of different soil mixing paddle configurations depending upon the existing soil conditions.

Another embodiment within the scope of the present invention uses a multi-shaft auger apparatus capable of augering boreholes of different diameter. For example, in one embodiment, a three-shaft auger machine is used in which the center shaft produces a borehole with a diameter substantially greater than the diameter of the boreholes produced by the two outer shafts.

In an alternative embodiment, a three-shaft auger machine is used wherein the two outer augers produce boreholes having a diameter substantially greater than the diameter of the borehole produced by the center shaft.

Boreholes of different diameter may be arranged in a pattern which efficiently eliminates interstitial spaces between adjacent boreholes. As a result, a larger area of contaminated soil may be fixated according to the methods of the present invention more efficiently than by use of existing techniques.

It is, therefore, an object of the present invention to provide apparatus and methods for fixation of soil contaminated with toxic waste which avoids the expense and time-consuming process of physically removing the contaminated soil.

An additional important object of the present invention is to provide apparatus and methods for fixation of soil contaminated with toxic waste which does not expose construction workers to the contaminants.

Still another object of the present invention is to provide apparatus and methods for fixation of soil contaminated with toxic waste which eliminate the risk of the contaminants migrating into the surrounding water supply.

Another object of the present invention is to provide apparatus and methods for fixation of soil contaminated with toxic waste which immobilizes the soil such that hazardous chemicals, compounds, or other constituents are trapped from escaping the fixated area.

Yet another object of the present invention is to provide apparatus and methods for fixation of soil contaminated with toxic waste which does not enlarge the area of contamination.

A further important object of the present invention is to provide apparatus and methods for fixation of soil contaminated with toxic waste which are adapted for treatment of shallow contaminated soil conditions.

These and other objects and features of the present invention will become more fully apparent from the following description and appended claims taken in conjunction with the accompanying drawings.

DETAILED DESCRIPTION OF THE PREFERRED EMBODIMENTS

A. Multi-Shaft Auger Machines

Figure 1:
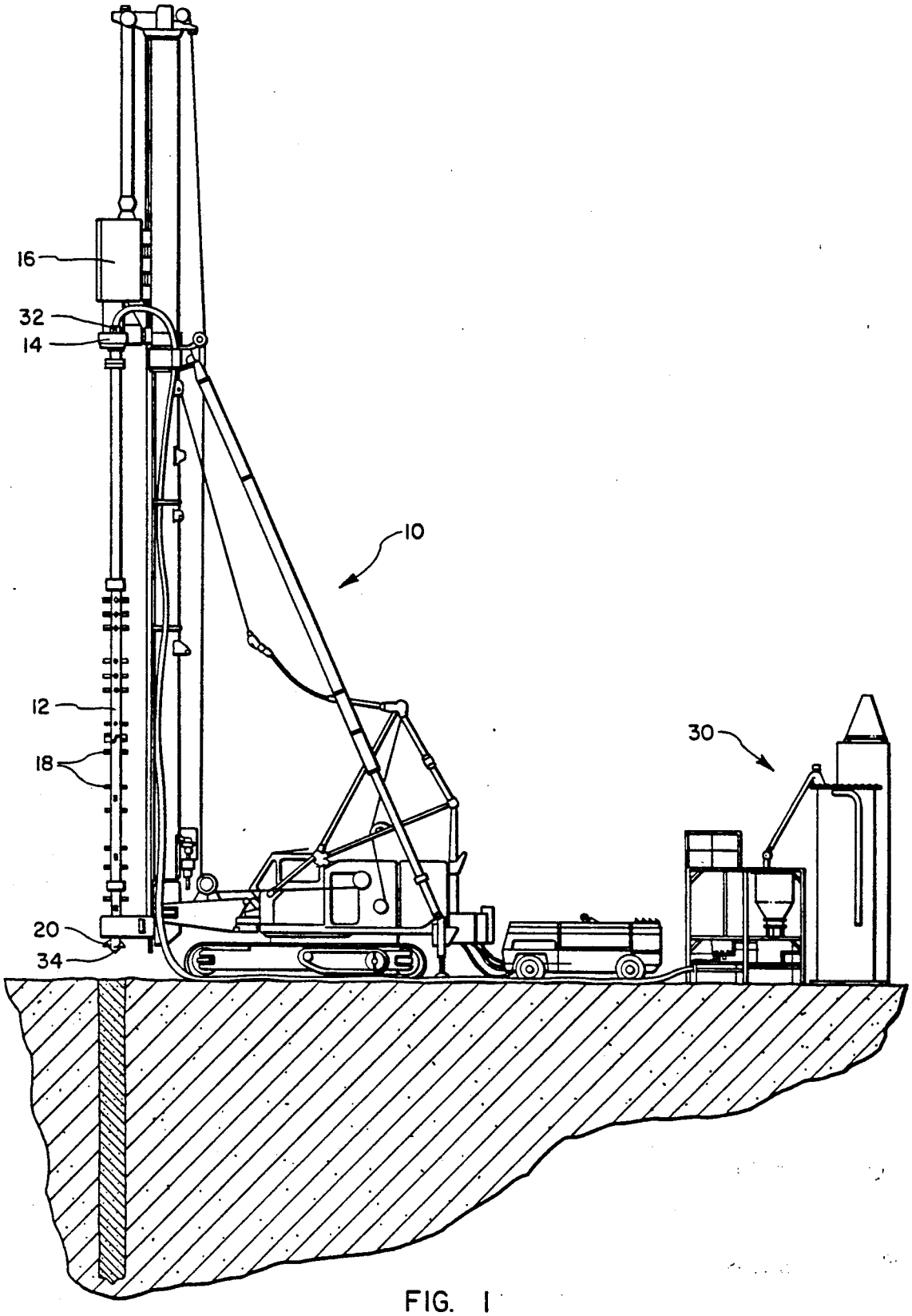
FIG. 1 is a plan view of one presently preferred embodiment within the scope of the present invention as it would appear in operation.

For a number of years, multi-shaft auger machines have been used in Japan to construct concrete-like columns in the ground without having to excavate the soil. These columns are sometimes referred to as "soilcrete" columns, because the soil is mixed with a cement hardener in situ. Upon hardening, the soilcrete columns possess characteristics of concrete columns, but they are constructed without the expense and time-consuming processes of removing and replacing the soil with concrete.

The soilcrete columns are usually arranged in a variety of patterns depending on the desired application. Soilcrete columns are used to improve the load bearing capacity of soft soils, such as sandy or soft clay soils. In other cases, the soilcrete columns are overlapped to form boundary walls, structural retaining walls, low to medium capacity soil-mixed caissons, and piles which act as a base for construction.

To produce soilcrete columns, a multi-shaft auger machine bores holes in the ground and simultaneously mixes the soil with a chemical hardening material pumped from the surface through the auger shaft to the end of the auger. Multiple columns are prepared while the soil-hardener mixture is still soft to form continuous walls or geometric patterns within the soil, depending on the purpose the soilcrete columns.

Because the soil is mixed in situ and because the soilcrete wall is formed in a single process step, the construction period is shorter than for other construction methods. Obviously, the costs of forming soilcrete columns are less than traditional methods requiring excavation of the soil in order to form concrete pillars or walls. In addition, because the soil is not removed from the ground, there is comparatively little material produced by such in situ processes that must be disposed of during the course of construction.

The boring and mixing operations are performed by multi-shaft drive units in order to make the process more efficient. The shafts typically contain soil mixing paddles and augers which horizontally and vertically mix the soil with the hardening material, thereby producing a column having a homogeneous mixture of the soil and the hardener.

As ground penetration occurs, the chemical hardener slurry is injected into the soil through the end of the hollow stemmed augers. The augers penetrate and break loose the soil and lift the soil to soil mixing paddles which blend the slurry and the soil. As the auger continues to advance downwardly through the soil, the soil and slurry are remixed by additional augers and paddles attached to the shaft.

Generally, the multi-shaft auger machines used to construct soilcrete columns are adapted for boring deep into the ground. Because the shafts bore deep into the ground, vertical mixing is important in order to produce a soilcrete column having a homogeneous mixture of the soil and the hardener. Unfortunately, conventional multi-shaft drive units are typically not adapted for thorough mixing of soil and chemical hardener in shallow soil conditions.

B. Applying Multi-Shaft Auger Machines to Soil Fixation

The present invention applies unrelated technology regarding in situ construction of columns and walls to solve the problems associated with treatment of contaminated soil. Soil fixation is achieved by augering a plurality of boreholes downwardly into the contaminated soil with a modified multi-shaft auger machine.

A chemical hardener is injected into contaminated soil while the boreholes are being augered. As the shafts rotate, a plurality of soil mixing paddles, extending outwardly from the shaft, blend the contaminated soil with the chemical hardener in situ. After the soil/hardener mixture hardens, the soil is immobilized such that hazardous chemicals, toxic compounds, and other soil constituents are trapped in order to prevent migration from the fixated area.

Reference is now made to the drawings wherein like parts are designated with like numerals throughout. Referring initially to FIG. 1, one presently preferred embodiment within the scope of the present invention is illustrated in connection with a multi-shaft auger machine as the machine would appear in operation.

The multi-shaft auger machine, generally designated 10, contains a plurality of vertical shafts, each shaft, shown generically as shaft 12, is attached to a gear box 14 at the upper end of the shaft. A motor 16 transfers power through the gear box to the shafts. Spaced throughout the length of each shaft are a plurality of soil mixing paddles 18. At the lower end of each shaft is a penetrating auger blade 20.

A chemical hardener is pumped from a grout plant, generally designated 30, through an opening 32 at the top of each shaft. Each shaft is hollow and contains a passageway therethrough. At the bottom of each shaft is a discharge opening 34 from which the chemical hardener is injected into the contaminated soil.

As discussed in greater detail hereinafter, this chemical hardener will typically include cement or cement products, bentonite, asphalt, and/or other hardeners or aggregates. It is from openings 34 that the chemical hardener (hereinafter sometimes referred to generically as "cement milk") is released into the soil to be mixed by the soil mixing paddles along the length of each shaft in order to form a generally homogeneous mixture of contaminated soil and cement milk.

It is particularly important to provide constant cement milk pressure and flow rate to each shaft of the multi-shaft auger machine in order to obtain a homogeneous mixture of the cement milk and the soil. If one shaft receives more cement milk than the other shafts, nonhomogeneous columns may result.

The resulting mixture of soil and chemical hardener is sometimes referred to as "soilcrete" because the hardener mixture often possesses physical properties similar to concrete. Nevertheless, the use of the terms "cement milk" and "soilcrete" does not mean that soil is mixed with concrete or that the chemical hardener necessarily contains cement.

Figure 2:
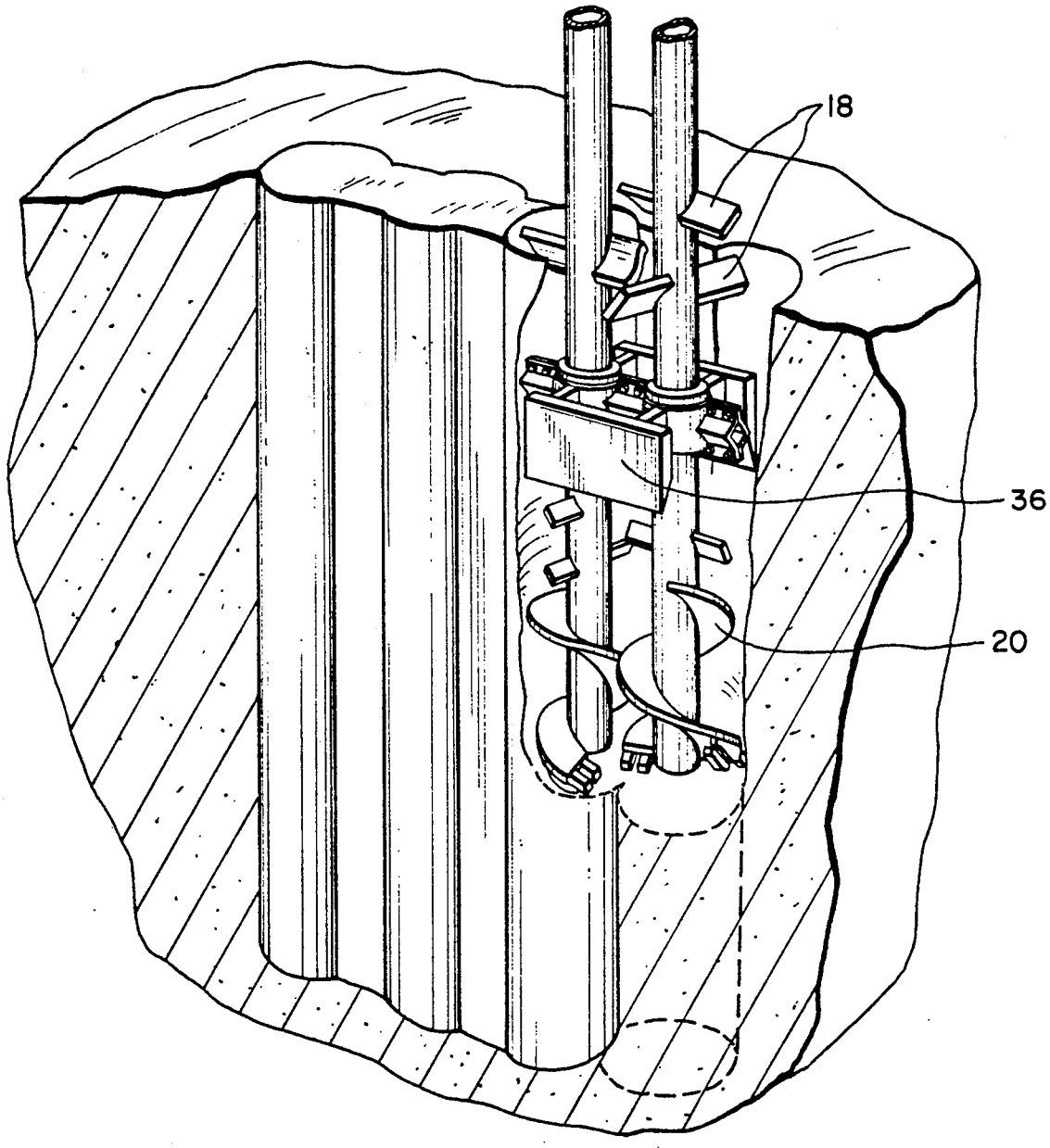
FIG. 2 is a partial cutaway perspective view of another embodiment within the scope of the present invention in the process of fixating soil contaminated with toxic waste.

Referring now to FIG. 2, an embodiment within the scope of the present invention in the process of fixating soil contaminated with toxic wastes is illustrated. FIG. 2 shows a two-shaft auger machine equipped with side cutting blades 36. The axes of the two shafts define a geometric soil mixing plane. The side cutting blades include two parallel blades which cut the soil between the adjacent columns along planes which are parallel to the geometric soil mixing plane defined by the shafts.

As the soil is cut by the cutting blades, the soil is thoroughly mixed with the cement milk and with the soil from the adjacent boreholes. In this way, adjacent soilcrete columns are integrally connected by substantial column overlap without physically moving the columns closer together or performing multiple borings on the soil adjacent to the two columns formed by the initial boring.

A two-shaft auger machine equipped with cutting blades as shown in FIG. 2, is ideally suited for fixation of soil contaminated with toxic waste. In order to fixate an area of soil contaminated with toxic waste, a series of parallel soilcrete walls which overlap and offset each other are constructed. FIG. 2 illustrates one method of constructing a soilcrete wall. Without the side cutting blades, a two-shaft auger machine would leave numerous interstitial spaces between adjacent columns. Each interstitial space would contain soil contaminated with toxic waste which could readily escape the fixated area.

Continuous wall formations may be constructed in situ by combining a series of individual soilcrete columns. After the machine's horizontal and vertical alignment is checked, the multi-shaft auger machine starts to penetrate downwardly through the soil. The process of penetrating downwardly is often referred to as an augering stroke.

As the auger blades move down to the predetermined depth (below the level of soil contamination), the injection of cement milk through the auger shaft is initiated. As the cement milk exits the auger shaft, it is mixed with the contaminated soil by the soil mixing paddles along the length of each auger. The resulting soil/hardener mixture is in the shape of a column within the borehole. The use of the term "borehole" in this specification and claims does not mean that the soil is removed to create a hole. Moreover, use of the term "column" may refer to either a single in situ column formation or generically to wall formations or continuous large-area soil formations.

The mixing ratio of the cement milk to the soil is determined on the basis of the contaminated soil conditions, which are determined and reported prior to boring the columns. The chemical hardener or cement milk composition varies depending upon the soil composition.

In most cases, the preferred chemical hardener (or "cement milk") will contain a cement or a cement substitute. Quite often, the cement milk also contains bentonite to make the fixated soil substantially water impervious. Bentonite may also be added to the cement milk when the soil is sandy or granular in order to provide an effective aggregate material with which to mix the slurry fluids.

When using the soil fixation processes of the present invention to fixate soil containing hazardous or toxic wastes, the cement component of the chemical hardener is preferably approved by the Environmental Protection Agency (EPA). One suitable cement composition is known as "HWT-22", manufactured by International Waste Treatment, Kansas.

Figure 3:
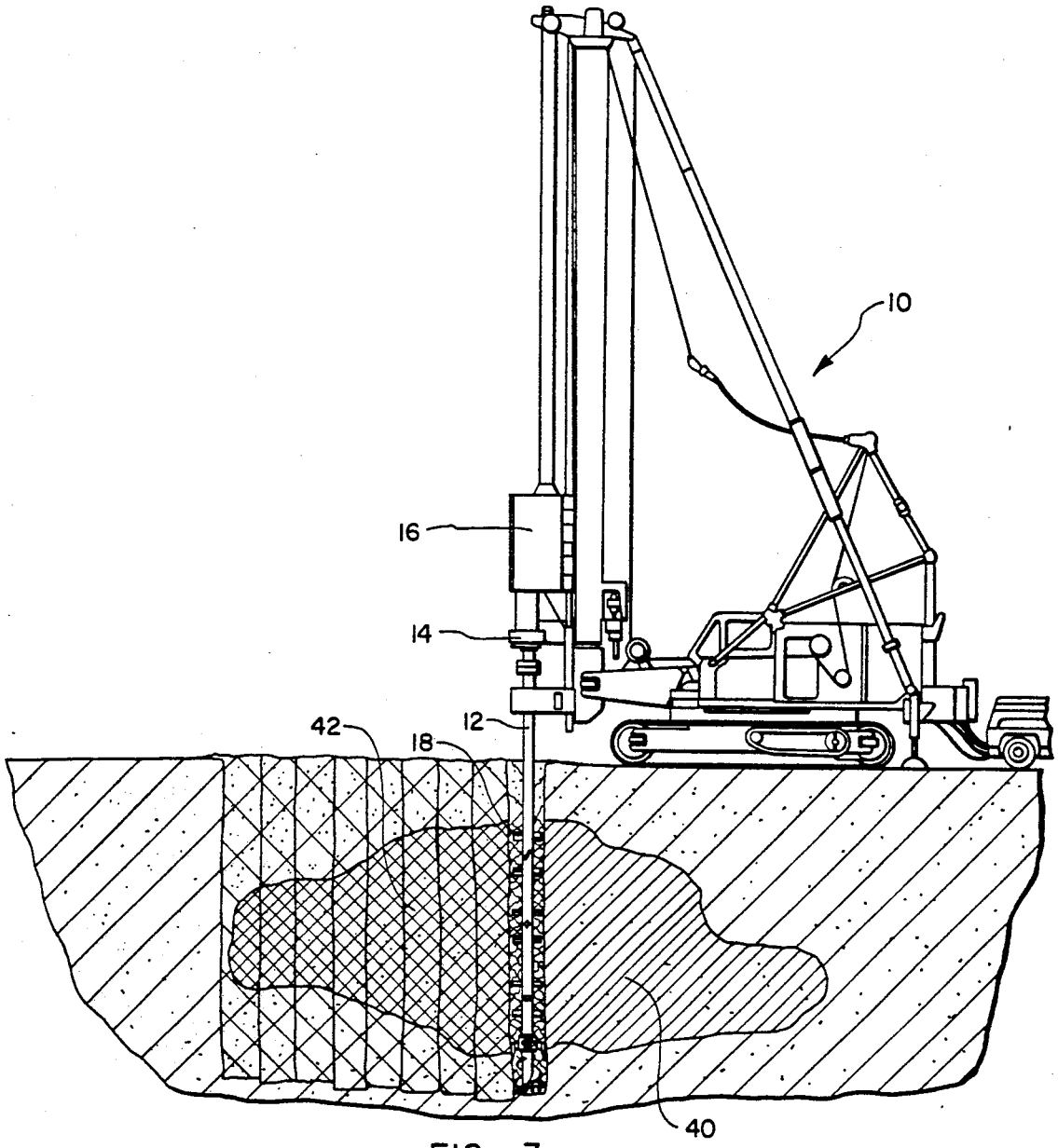
FIG. 3 is a plan view of an embodiment within the scope of the present invention in the process of fixating soil contaminated with toxic waste.
Figure 4:
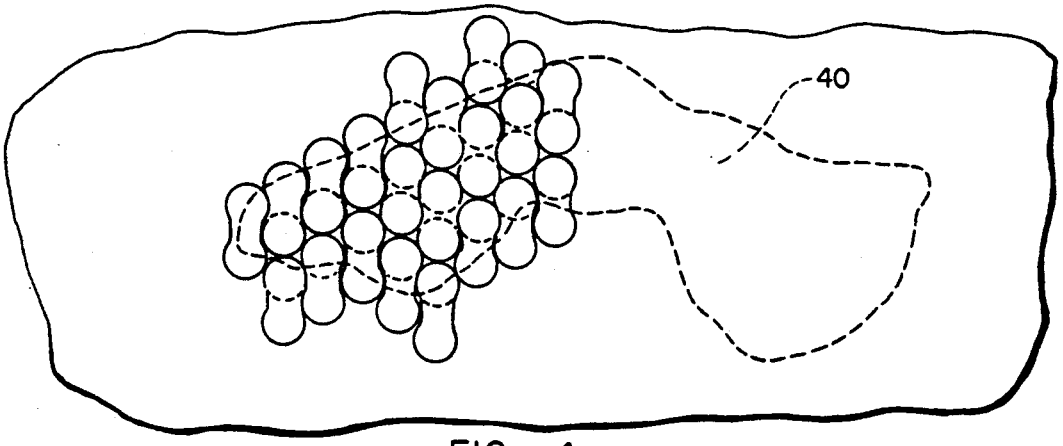
FIG. 4 is a cross-sectional view of an area of soil contaminated with toxic waste in the process of being fixated.

FIGS. 3 and 4 illustrate the general method for fixation of soil contaminated with toxic waste. Soil contaminated with toxic waste includes soil containing contaminants which are harmful to humans as well as plant and animal life. Certainly toxic chemicals, heavy metals, and harmful organic compounds such as polychlorinated biphenyls (PCBs), phencyclidines (PCPs), and dioxins would be considered harmful soil contaminants. Once an area of contaminated soil 40 is located, a multi-shaft auger apparatus proceeds to auger a series of boreholes throughout the entire area in which there is contaminated soil. In order to present migration of the contaminants over a prolonged period of time, it is particularly important that substantially all of the contaminated soil between boreholes is blended with chemical hardener, Thus, the number of interstitial spaces between the adjacent boreholes should be minimized. In addition, each borehole should penetrate to a depth below the level of soil contamination.

FIG. 4 illustrates a cross-sectional view of an area of contaminated soil 40 in which a series of boreholes constructed with a two-shaft auger machine equipped with side cutting blades have fixated a portion of the contaminated soil. The fixated soil is labeled 42.

As mentioned above, during the process of fixating soil contaminated with toxic wastes the soil should be thoroughly blended with the chemical hardener. However, the blending process should not be so vigorous that the contaminated soil is brought to the ground surface. The area of contaminated soil should be contained and not enlarged. As a result, a number of soil mixing paddle configurations are disclosed which promote in situ mixing of the soil with the cement milk.

Figure 5:
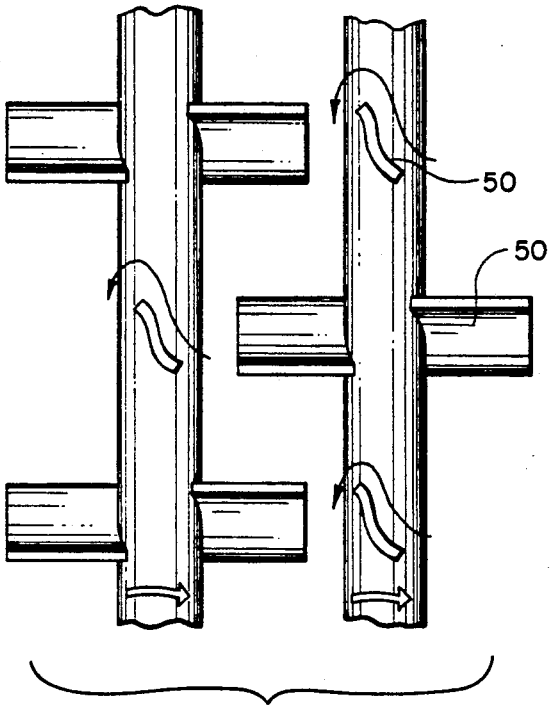
FIG. 5 is a plan view of one embodiment within the scope of the present invention illustrating "S"-shaped soil mixing paddles.

FIG. 5 illustrates one preferred embodiment of soil mixing paddles within the scope of the present invention. The cross-sectional configuration of soil mixing paddles 50 shown in FIG. 5 is a slanted "S" shape. Slanted S-shaped soil mixing paddles are particularly useful in sand or silty soil. They may also be used when the soil is more cohesive, because the slanted S-shaped mixing paddles tend to cause the soil to tumble. As the shafts rotate within the soil, the soil is lifted along the front of the mixing paddle and then the soil drops behind the paddle as the paddle continues its rotation.

Figure 6:
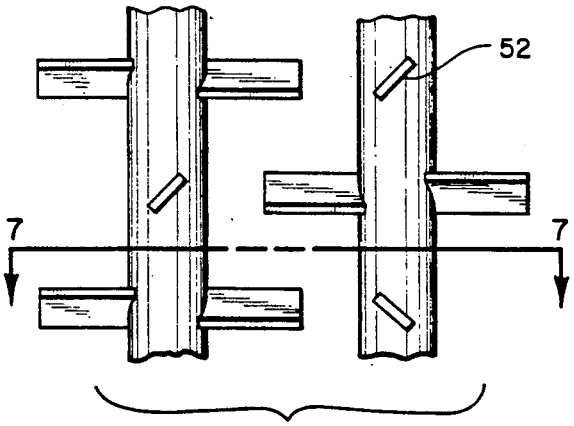
FIG. 6 is a plan view of one presently preferred embodiment within the scope of the present invention illustrating linear shaped soil mixing paddles.
Figure 7:
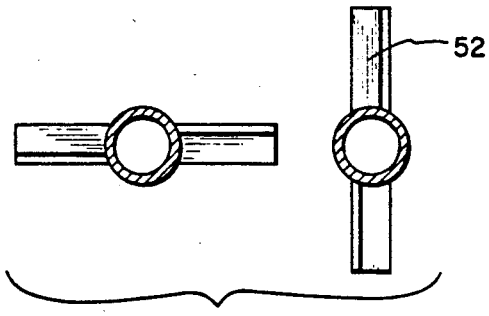
FIG. 7 is a cross-sectional view of the embodiment of the present invention illustrated in FIG. 6 taken along line 7—7.

FIGS. 6 and 7 illustrate an alternative embodiment of soil mixing paddles within the scope of the present invention. The cross-sectional configuration of soil mixing paddles 52 shown in FIG. 6 is rectangular. The rectangular soil mixing paddles cut and stir the soil more than the slanted "S" shaped soil mixing paddles.

As shown in FIG. 6, the slant of the rectangular soil mixing paddles may alternate along the length of the shaft. Alternating the slant of the rectangular soil mixing paddles provides more thorough blending of the contaminated soil with the cement milk.

The soil mixing paddles illustrated in FIGS. 6 and 7 are arranged in pairs along the length of the shaft. Each pair of soil mixing paddles is planar with respect to each other and orthogonal with respect to the corresponding shaft.

As shown in FIG. 7, each pair of soil mixing paddles is horizontally offset from corresponding soil mixing paddles on the adjacent shaft. Depending upon the soil conditions, it may also be desirable to vertically offset each pair of soil mixing paddles from corresponding soil mixing paddles of an adjacent shaft.

Figure 8:
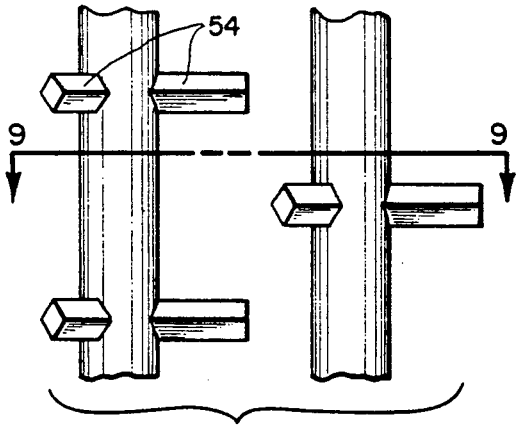
FIG. 8 is a plan view of one presently preferred embodiment within the scope of the present invention illustrating rhomboidal shaped soil mixing paddles.
Figure 9:
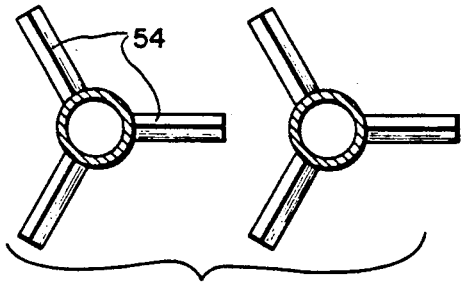
FIG. 9 is a cross-sectional view of the embodiment of the present invention illustrated in FIG. 8 taken along line 9—9.

FIGS. 8 and 9 illustrate another preferred embodiment of soil mixing paddles within the scope of the present invention. The cross-sectional configuration of soil mixing paddles 54 shown in FIG. 8 is romboidal. Soil mixing paddles are arranged in groups of three along the length of each shaft.

As is more clearly illustrated in FIG. 9, the soil mixing paddles are evenly spaced around the periphery of each shaft. In addition, each group of three soil mixing paddles is planar. Soil mixing paddles 54 shown in FIG. 8 are vertically offset from corresponding soil mixing paddles on the adjacent shaft.

Figure 10:
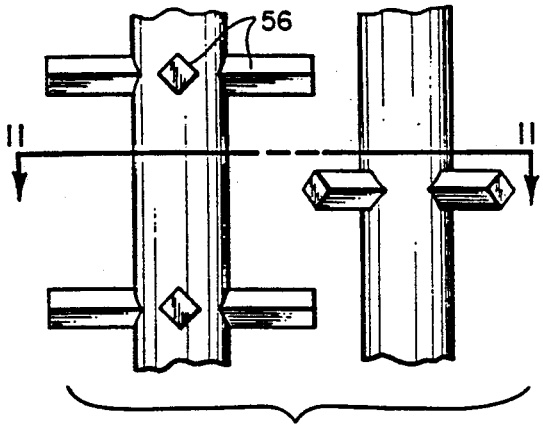
FIG. 10 is a plan view of one presently preferred embodiment within the scope of the present invention illustrating square shaped soil mixing paddles arranged in groups of four.
Figure 11:
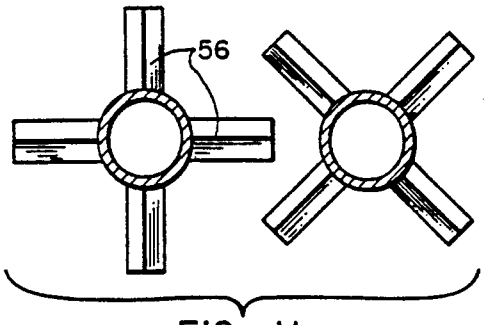
FIG. 11 is a cross-sectional view of the embodiment of the present invention illustrated in FIG. 10 taken along line 11—11.

FIGS. 10 and 11 illustrate another preferred embodiment of soil mixing paddles within the scope of the present invention. The cross-sectional configuration of soil mixing paddles 56 shown in FIG. 10 is square. Soil mixing paddles 56 are arranged in groups of four along the length of each shaft. Each of the soil mixing paddles is evenly spaced around the periphery of the shaft. Each group of soil mixing paddles is planar and vertically offset from a corresponding group of soil mixing paddles on the adjacent shaft. In addition, each group of soil mixing paddles is horizontally offset from a corresponding group of soil mixing paddles on the adjacent shaft.

Figure 12:
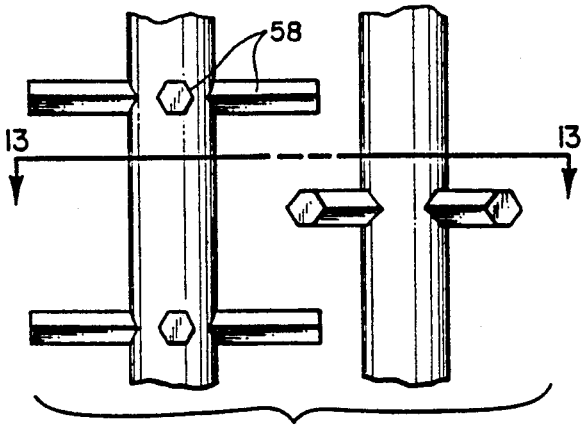
FIG. 12 is a plan view of one presently preferred embodiment within the scope of the present invention illustrating hexagonal shaped soil mixing paddles arranged in groups of four.
Figure 13:
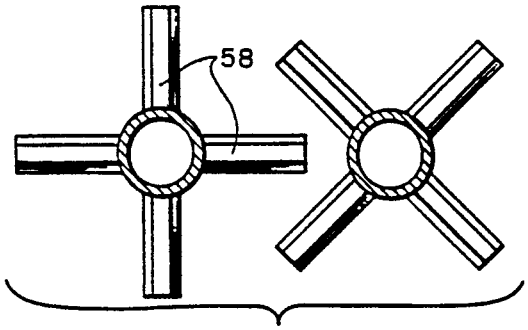
FIG. 13 is a cross-sectional view of the embodiment of the present invention illustrated in FIG. 12 taken along line 13—13.

FIGS. 12 and 13 illustrate another preferred embodiment of soil mixing paddles within the scope of the present invention. The cross-sectional configuration of soil mixing paddles 58 shown in FIG. 12 is hexagonal. Soil mixing paddles 58 are shown in groups of four along the length of each shaft. Each group of soil mixing paddles is planar and vertically offset from a corresponding group of soil mixing paddles on the adjacent shaft. Each group of soil mixing paddles is also horizontally offset from a corresponding group of soil mixing paddles on the adjacent shaft.

Each of the soil mixing paddle configurations illustrated in FIGS. 5–13 minimize the vertical movement of soil throughout the borehole, while simultaneously maximizing the blending of contaminated soil with the cement milk.

Figure 14:
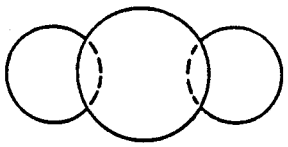
FIG. 14 is a view illustrating the cross-sectional configuration of boreholes produced by a three-shaft auger machine wherein the inner borehole has a diameter greater than the diameters of the two outer boreholes.

FIG. 14 is a view illustrating the cross-sectional configuration of boreholes produced by a three-shaft auger machine in which the inner borehole has a diameter greater than the diameters of the two outer boreholes. Boreholes of different diameter may be arranged in a pattern which efficiently eliminates interstitial spaces between adjacent boreholes. As a result, a larger area of contaminated soil may be fixated according to the methods of the present invention more efficiently than by use of boreholes of equal diameter.

Figure 15:
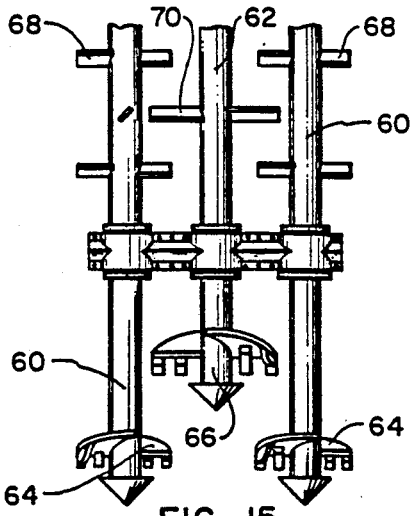
FIG. 15 is a plan view of the embodiment within the scope of the present invention capable of forming the boreholes of FIG. 14.

FIG. 15 illustrates a three-shaft auger machine capable of forming the borehole configuration shown in FIG. 14. The three-shaft auger machine shown in FIG. 15 contains two outer shafts 60 and an inner shaft 62. At the lower end of each outer shaft is a penetrating auger 64. At the lower end of the inner shaft is a penetrating auger 66.

As shown in FIG. 15, penetrating auger 66 is vertically offset from penetrating augers 64. Because the penetrating augers are offset, penetrating auger 66 is capable of having a larger diameter than penetrating augers 64 without interfering with the operation of penetrating auger 64.

Penetrating augers 64 and 66 shown in FIG. 15 have only a slight spiral configuration compared with penetrating auger 20 of FIG. 2 which has a substantial spiral. Penetrating augers having only a slight spiral are particularly useful in cohesive soils such as clay soils. In contrast, penetrating augers with a substantial spiral are most often used in soils which are granular such as sandy soils. Because toxic wastes are usually in more cohesive soils, penetrating augers with a slight spiral are commonly used when fixating soils containing toxic waste.

Also attached to each outer shaft 60 are a plurality of soil mixing paddles 68. Soil mixing paddles 68 extend outwardly from shaft 60 to a distance approximately equal to the diameter of penetrating augers 64. Similarly, a plurality of soil mixing paddles 70 are attached to inner shaft 62. Soil mixing paddles 70 also extend outwardly from inner shaft 62 to a distance approximately equal to the diameter of penetrating auger 66.

Generally, each shaft on a multi-shaft auger machine with three shafts or more rotates in a direction opposite the rotation of adjacent shafts. As shown in FIG. 15, penetrating auger 66 attached to inner shaft 62 has a spiral configuration opposite the penetrating shafts attached to outer shaft 60.

Figure 16:
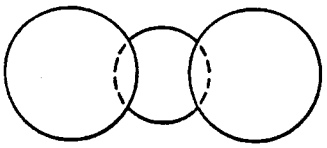
FIG. 16 is a view illustrating the cross-sectional configuration of boreholes produced by a three-shaft auger machine wherein the two outer boreholes have a diameter greater than the diameter of the inner borehole.

FIG. 16 is a view illustrating the cross-sectional configuration of boreholes produced by a three-shaft auger machine in which the inner borehole has a diameter less than the diameters of the two outer boreholes. As discussed above, boreholes of different diameters may be arranged in patterns which efficiently eliminate interstitial spaces between adjacent boreholes.

Figure 17:
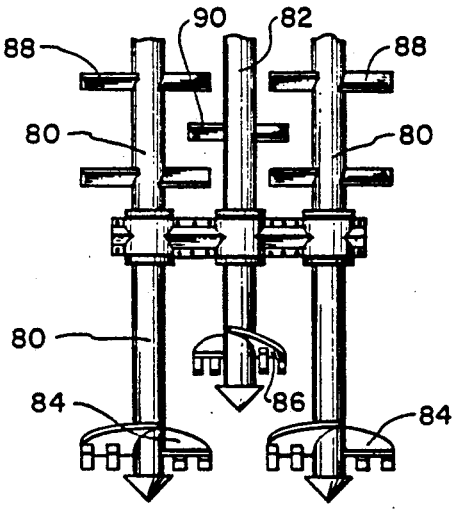
FIG. 17 is a plan view of the embodiment within the scope of the present invention capable of forming boreholes of the configuration illustrated in FIG. 16.

FIG. 17 illustrates a three-shaft auger machine capable of forming the borehole configuration shown in FIG. 16. The three-shaft auger machine shown in FIG. 17 contains two outer shafts 80 and an inner shaft 82. At the lower end of each outer shaft is a penetrating auger 84. At the lower end of the inner shaft is a penetrating auger 86.

As shown in FIG. 17, penetrating auger 86 is vertically offset from penetrating augers 84. Because the penetrating augers are offset, penetrating augers 84 are capable of having a larger diameter than penetrating auger 86 without interfering with the operation of penetrating auger 86.

Also attached to each outer shaft 80 are a plurality of soil mixing paddles 88. Soil mixing paddles 88 extend outwardly from shaft 80 to a distance approximately equal to the diameter of penetrating augers 84. Similarly, a plurality of soil mixing paddles 90 are attached to inner shaft 82. Soil mixing paddles 90 also extend outwardly from inner shaft 82 to a distance approximately equal to the diameter of penetrating auger 86.

The embodiment shown in FIG. 17 contains a pair of parallel side cutting blades 92 which function as described above. The side cutting blades are parallel to a geometric soil mixing plane defined by the center of shafts 80 and 82. The distance between the side cutting blades is approximately equal to the diameter of penetrating auger 86. Thus, the side cutting blades cut the soil along planes which are approximately tangential to the borehole formed by penetrating auger 86.

Figure 18:
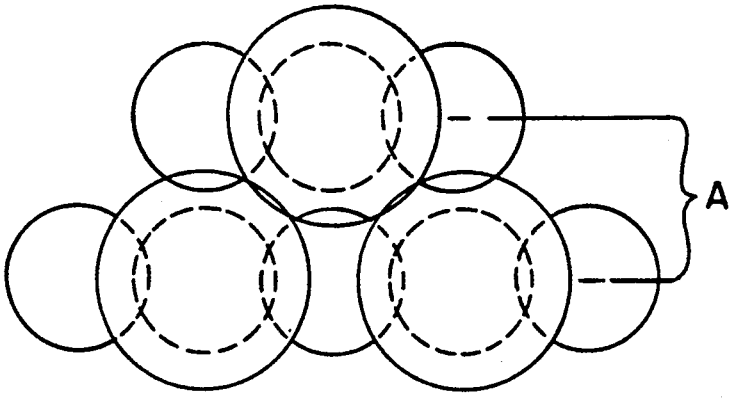
FIG. 18 is a view illustrating the cross-sectional configuration of boreholes produced by a series of adjacent augering strokes of the embodiment of the present invention illustrated in FIG. 15.
Figure 19:
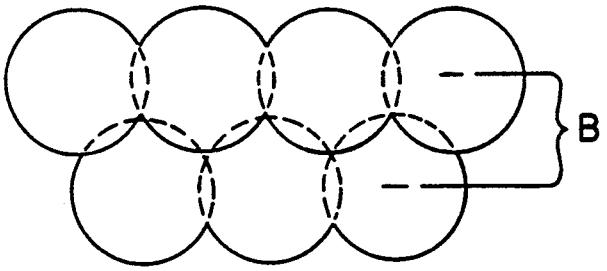
FIG. 19 is a view illustrating the cross-sectional configuration of boreholes produced by a three-shaft auger machine capable of producing boreholes of substantially equal diameter.

FIGS. 18 and 19 illustrate the increased efficiency which can be achieved by using a three-shaft auger machine which produces boreholes of different diameter as opposed to a three-shaft auger machine producing boreholes of substantially equal diameter. FIG. 18 illustrates the cross-sectional configuration of boreholes produced by a three-shaft auger machine similar to the embodiment of the present invention illustrated in FIG. 15. FIG. 19 is a view illustrating the cross-sectional configuration of boreholes produced by a three-shaft auger machine capable of producing boreholes of substantially equal diameter.

In both FIGS. 18 and 19, the boreholes are arranged so as to eliminate interstitial spaces between adjacent boreholes. The distance A of FIG. 18 and the distance B of FIG. 19 represent the distance between respective soil mixing planes of the two parallel wall formations. As a result, the distances A and B are a measure of the relative efficiency of the two borehole configurations when combined to continuously cover a large area without interstitial spaces.

As discussed above, large areas of contaminated soil may be fixated by augering a series of parallel wall formations which overlap each other sufficient to minimize the number of interstitial spaces between adjacent boreholes. Continuous soilcrete walls are constructed by linking sets of columns formed in a sequence of augering strokes.

Figure 20:
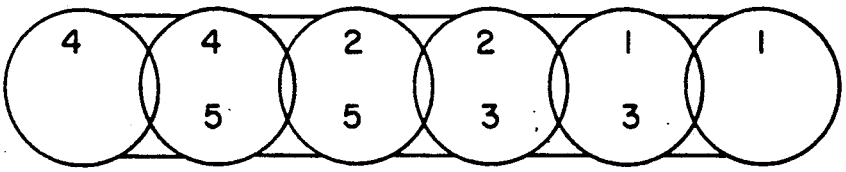
FIG. 20 is a view illustrating one augering stroke sequence which may be employed to construct continuous soilcrete walls.
Figure 21:
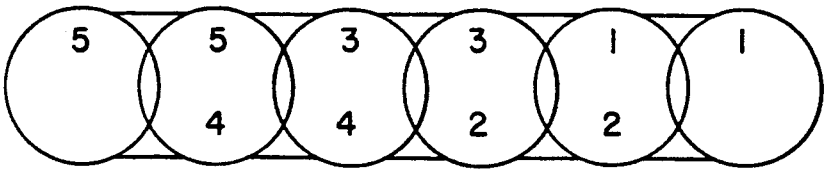
FIG. 21 is a view illustrating an alternative augering stroke sequence which may be employed to construct continuous soilcrete walls.

FIGS. 20 and 21 illustrate two alternative augering stroke sequences for constructing continuous soilcrete walls. As shown in FIG. 20, after the first augering stroke, two soilcrete columns are formed each numbered as column 1. The multi-shaft auger machine is advanced horizontally such that the first shaft is positioned adjacent to the column previously formed by the second shaft. The second augering stroke forms two more soilcrete columns each numbered as column 2.

The multi-shaft auger machine is then moved to a position such that the first shaft is positioned over columns formed during the first and second strokes. The third augering stroke joins the previously formed columns into a continuous wall formation. The columns formed during the third and succeeding augering strokes are numbered accordingly. The process is repeated until the desired wall formation is complete.

FIG. 21 illustrates an alternative method of forming continuous soilcrete walls. After the first augering stroke, two columns are formed each numbered as column 1. The multi-shaft auger machine is advanced horizontally to a position for the second augering stroke such that the first shaft is centered over the column previously formed by the second shaft. In this way, the previous stroke always serves as a guide for the next stroke. This feature is also illustrated in FIG. 2. This procedure of the present invention not only guarantees the construction of complete, continuous columns, but also thoroughly mixes the contaminated soil with the cement milk throughout the length of the continuous wall.

The stroke sequence illustrated in FIG. 21 may not be suitable in soil conditions which are hard and rocky. In hard soil, the auger shafts will tend to deviate into the area of least resistance which would consist of a freshly bored adjacent borehole. In such cases, it would be preferable to use the stroke sequence illustrated in FIG. 20.

Figure 22:
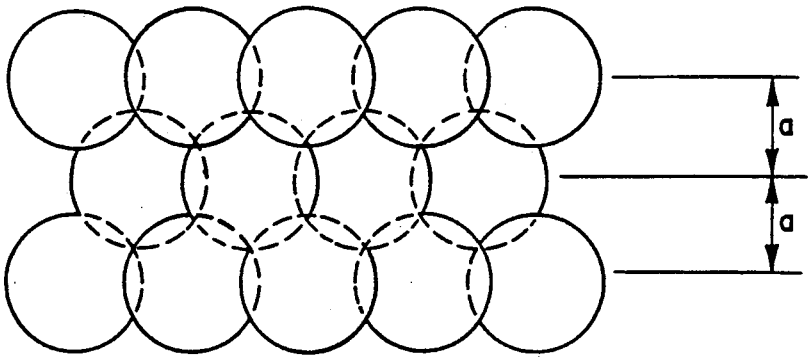
FIG. 22 is a view illustrating the cross-sectional configuration of continuous soilcrete walls constructed parallel to each other and slightly offset from each adjacent wall.
Figure 23:
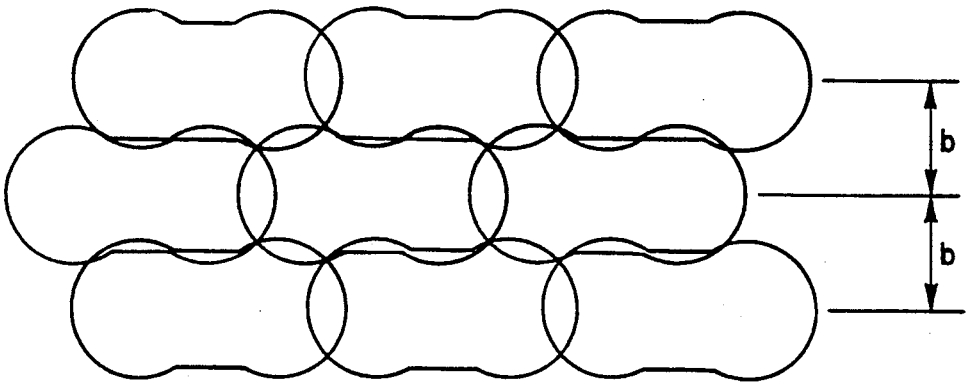
FIG. 23 is a view illustrating the cross-sectional configuration of a group of parallel soilcrete walls constructed with a two-shaft auger machine using side cutting blades.
Figure 24:
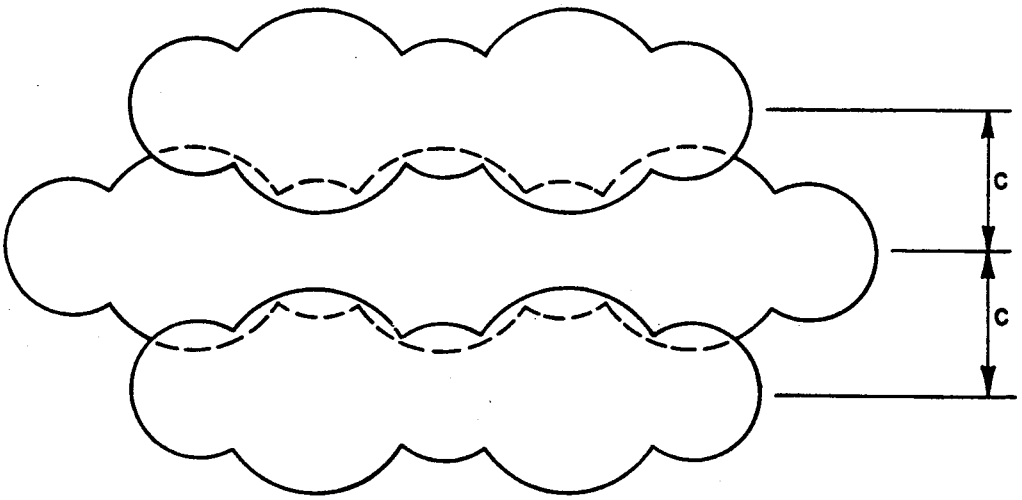
FIG. 24 is a view illustrating the cross-sectional configuration of a group of parallel soilcrete walls constructed by a three-shaft auger machine as illustrated in the embodiment of FIG. 15.

FIGS. 22, 23, and 24 illustrate alternative augering patterns for fixating large areas of contaminated soil while minimizing the formation of interstitial spaces between adjacent columns. In each figure, the parallel soilcrete walls are constructed so as to offset and slightly overlap each adjacent wall.

FIG. 22 is a view illustrating the cross-sectional configuration of a group of parallel soilcrete walls constructed of boreholes having substantially equal diameter. The distance between adjacent soil mixing planes is labeled "a".

FIG. 23 is a view illustrating the cross-sectional configuration of a group of parallel soilcrete walls constructed with a two-shaft auger machine using side cutting blades. The distance between adjacent soil mixing planes is labeled "b". Because $b>a$, it will be appreciated that the use of side cutting blades improves the overall efficiency of the soil fixation process.

FIG. 24 is a view illustrating the cross-sectional configuration of a group of parallel soilcrete walls constructed by a three-shaft auger machine which produces boreholes of different diameter. The distance between adjacent soil mixing planes is labeled "c". Because $c>b$, multi-shaft auger machines which produce boreholes of different diameter may fixate soils containing toxic wastes more efficiently than either of the methods illustrated in FIGS. 22 and 23.

From the foregoing, it will be appreciated that the present invention provides apparatus and methods for fixation of soil contaminated with toxic wastes which avoids the expense and time-consuming process of physically removing the contaminated soil. This is accomplished by blending the contaminated soil with a chemical hardener in situ through the use of multi-shaft auger machines.

Additionally, it will be appreciated that the present invention provides apparatus and methods for fixation of soil contaminated with toxic wastes which does not expose construction workers to the contaminants. Likewise, it will be appreciated that the present invention provides apparatus and methods for fixation of soil contaminated with toxic waste which eliminate the risk of the contaminants migrating into the surrounding water supply. This is achieved because the present invention immobilizes the soil such that hazardous chemicals, compounds, or other constituents are trapped from escaping the fixated area.

It will also be appreciated that the present invention provides apparatus and methods for fixation of soil contaminated with toxic waste which does not enlarge the area of contamination. Additionally, the present invention is adapted for fixation of shallow contaminated soil conditions.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for in situ fixation of soil contaminated with toxic wastes using a multi-shaft auger apparatus, the method comprising the steps of:

(a) augering a plurality of boreholes downwardly into the contaminated soil with an auger apparatus having a plurality of shafts, each shaft having penetrating means at a lower end of the shaft and a plurality of soil mixing paddles extending outwardly from the shaft;

(b) injecting a chemical hardener into the contaminated soil during the augering of the boreholes;

(c) blending the contaminated soil and the chemical hardener in situ with the soil mixing paddles to form a soil/hardener mixture, said blending process minimizing the vertical movement of the contaminated soil out of the boreholes in order to maximize in situ containment of the contaminated soil;

(d) withdrawing the multi-shaft auger apparatus from the contaminated soil; and (e) allowing the soil/hardener mixture to cure to form a hardened column in the borehole, thereby fixating the contaminated soil.

2. A method for fixation of soil contaminated with toxic wastes using a multi-shaft auger apparatus as defined in claim 1, further comprising the steps of:

(f) moving the multi-shaft auger apparatus to a position such that the shafts are adjacent to previously augered boreholes; and (g) repeating the augering, injecting, blending, withdrawing, and moving steps (a) through (d) and step (f) in the contaminated soil adjacent to the previously augered boreholes containing the soil/hardener mixture, thereby fixating the contaminated soil.

3. A method for fixation of soil contaminated with toxic wastes using a multi-shaft auger apparatus as defined in claim 2, wherein the repeated augering, injecting, blending, withdrawing, and moving steps are performed in such a manner that the interstitial spaces between the adjacent boreholes are minimized and that substantially all of the contaminated soil between the boreholes is blended with the chemical hardener.

4. A method for fixation of soil contaminated with toxic wastes using a multi-shaft auger apparatus as defined in claim 2, wherein the multi-shaft auger apparatus is positioned during moving step (f) such that one of the shafts of the auger apparatus substantially overlaps a previously augered borehole containing the soil/hardener mixture so that said shaft reaugers said previously augered boreholes and the other shafts auger additional boreholes in the contaminated soil.

5. A method for in situ fixation of soil contaminated with toxic wastes as defined in claim 2, wherein the multi-shaft auger apparatus is positioned during moving step (f) such that all of the shafts are offset from the previously augered boreholes and such that the shafts only overlap the previously augered boreholes containing the soil/hardener mixture sufficient to minimize interstitial spaces between the adjacent boreholes so that substantially all of the contaminated soil between the boreholes is blended with the chemical hardener.

6. A method for in situ fixation of soil contaminated with toxic wastes using a multi-shaft auger apparatus as defined in claim 1, wherein the chemical hardener injected into the soil includes a cement product.

7. A method for in situ fixation of soil contaminated with toxic wastes using a multi-shaft auger apparatus as defined in claim 1, wherein the chemical hardener injected into the soil includes bentonite.

8. A method for in situ fixation of soil contaminated with toxic wastes using a multi-shaft auger apparatus as defined in claim 1, wherein the augering of the boreholes is performed to a soil-penetration depth of at least five meters.

9. A method for in situ fixation of soil contaminated with toxic wastes using a multi-shaft auger apparatus as defined in claim 1, wherein the boreholes are augered during step (a) to a soil-penetration depth below which the soil is contaminated.

10. A method for in situ fixation soil contaminated with toxic wastes using a multi-shaft auger apparatus, the method comprising the steps of:

(a) augering a plurality of boreholes downwardly into the contaminated soil with an auger apparatus having a plurality of substantially parallel and coplanar shafts, said shafts defining a geometric soil mixing plane, each of the shafts having a penetrating auger at a lower end, means for rotating the shaft at an upper end of the shaft, and a plurality of soil mixing paddles extending outwardly from the shaft and positioned between the upper and lower ends of the shaft;

(b) injecting a chemical hardener into the contaminated soil during the augering of the boreholes;

(c) blending the contaminated soil and the chemical hardener in situ with the soil mixing paddles to form a soil/hardener mixture, said blending process minimizing the vertical movement of the contaminated soil out of the boreholes in order to maximize in situ containment of the contaminated soil;

(d) withdrawing the multi-shaft auger apparatus from the contaminated soil;

(e) moving the multi-shaft auger apparatus to a position such that the shafts are adjacent to previously augered boreholes;

(f) repeating the augering, injecting, blending, withdrawing, and moving steps (a) through (e) in the contaminated soil adjacent to the previously augered boreholes containing the soil/hardener mixture, thereby fixating the adjacent contaminated soil in the soil/hardener mixture; and (g) allowing the soil/hardener mixture to cure to form a hardened mass in which the contaminated soil is fixated.

11. A method for in situ fixation of soil contaminated with toxic wastes using a multi-shaft auger apparatus as defined in claim 10, wherein the repeated augering, injecting, blending, withdrawing, and moving steps are performed in such a manner that the interstitial spaces between the adjacent boreholes are minimized and that substantially all of the contaminated soil between the boreholes is blended with the chemical hardener.

12. A method for in situ fixation of soil contaminated with toxic wastes using a multi-shaft auger apparatus as defined in claim 11, wherein the multi-shaft auger apparatus is positioned during the moving step (e) such that one of the shafts of the auger apparatus substantially overlaps a previously augered borehole containing the soil/hardener mixture so that said shaft reaugers said previously augered borehole and the other shaft augers additional boreholes in the contaminated soil.

13. A method for in situ fixation of soil contaminated with toxic wastes as defined in claim 11, wherein the multi-shaft auger apparatus is positioned during moving step (e) at the contaminated soil adjacent the previously augered boreholes to define a second geometric soil mixing plane, said second geometric soil mixing plane being distanced from the first geometric soil mixing plane such that the interstitial spaces between the boreholes in the first geometric soil mixing plane and the boreholes in the second geometric soil mixing plane are minimized so that substantially all of the contaminated soil between the boreholes is blended with the chemical hardener.

14. A method for in situ fixation of soil contaminated with toxic wastes using a multi-shaft auger apparatus as defined in claim 11, wherein the chemical hardener injected into the soil includes a cement product.

15. A method for in situ fixation of soil contaminated with toxic wastes using a multi-shaft auger apparatus as defined in claim 11, wherein the chemical hardener injected into the soil includes bentonite.

16. A method for in situ fixation of soil contaminated with toxic wastes using a multi-shaft auger apparatus as defined in claim 11, wherein the boreholes are augering during step (a) to a soil-penetration depth below which the soil is contaminated.

17. A method for in situ fixation of soil contaminated with toxic wastes using a two-shaft auger apparatus, the method comprising the steps of:

(a) augering two boreholes downwardly into the contaminated soil with an auger apparatus having two substantially parallel and coplanar shafts, said shafts defining a geometric soil mixing plane, each of the shafts having a penetrating auger at a lower end, means for rotating the shaft at an upper end of the shaft, and a plurality of soil mixing paddles extending outwardly from the shaft and positioned between the upper and lower ends of the shaft;

(b) injecting a chemical hardener into the soil during the augering of the borehole;

(c) blending the contaminated soil and the chemical hardener in situ with the soil mixing paddles to form a soil/hardener mixture, said blending process minimizing the vertical movement of the contaminated soil out of the boreholes in order to maximize in situ containment of the contaminated soil;

(d) withdrawing the two-shaft auger apparatus from the contaminated soil;

(e) moving the multi-shaft auger apparatus to a position such that the shafts are adjacent to previously augered boreholes;

(f) repeating the augering, injecting, blending, withdrawing, and moving steps (a) through (e) in the contaminated soil adjacent to the previously augered boreholes containing the soil/hardener mixture, in a manner such that the interstitial spaces between the adjacent boreholes are minimized and that substantially all of the contaminated soil between the boreholes is blended with the chemical hardener; and (g) allowing the soil/hardener mixture to cure to form a hardened mass in which the contaminated soil is fixated.

18. A method for in situ fixation of soil contaminated with toxic wastes using a two-shaft auger apparatus as defined in claim 17, further comprising the step of cutting the soil with at least two cutting blades attached to the two-shaft auger apparatus along planes approximately parallel to the soil mixing plane such that the adjacent boreholes form a single column having a minimum thickness approximately equal to the diameter of the smallest borehole and the interstitial spaces between the adjacent boreholes are minimized.

19. A method for in situ fixation of soil contaminated with toxic wastes using a two-shaft auger apparatus as defined in claim 17, wherein the two-shaft auger apparatus is positioned during the moving step (e) such that one of the shafts of the auger apparatus substantially overlaps a previously augered borehole containing the soil/hardener mixture so that said shaft reaugers said previously augered borehole and the other shaft augers an additional borehole in the contaminated soil.

20. A method for in situ fixation of soil contaminated with toxic wastes using a two-shaft auger apparatus as defined in claim 19, further comprising the step of cutting the soil with at least two cutting blades attached to the two-shaft auger apparatus along planes approximately parallel to the soil mixing plane such that the adjacent boreholes form a single column having a minimum thickness approximately equal to the diameter of the smallest borehole and the interstitial spaces between the adjacent boreholes are minimized.

21. A method for in situ fixation of soil contaminated with toxic wastes using a two-shaft auger apparatus as defined in claim 17, wherein a first and second borehole are augered in the contaminated soil during augering step (a) by the first and second shafts of the auger apparatus; and wherein the first shaft is positioned during moving step (e) so that it is adjacent the second borehole such that a third borehole and a fourth borehole are augered into the soil by the first and second shafts; and further comprising reaugering the second borehole with the first shaft and the third borehole with the second shaft, respectively, such that the first, second, third, and fourth boreholes form adjacent boreholes of soil/hardener mixture.

22. A method for in situ fixation of soil contaminated with toxic wastes using a two-shaft auger apparatus as defined in claim 21, further comprising the step of cutting the soil with at least two cutting blades attached to the two-shaft auger apparatus along planes approximately parallel to the soil mixing plane such that the adjacent boreholes form a single column having a minimum thickness approximately equal to the diameter of the smallest borehole and the interstitial spaces between the adjacent boreholes are minimized.

23. A method for in situ fixation of soil contaminated with toxic wastes using a two-shaft auger apparatus as defined in claim 20, further comprising the steps of sequentially repeating the augering, injecting, blending, withdrawing, and moving steps (a) through (e) in the contaminated soil adjacent the previously augered boreholes to define a second geometric soil mixing plane, said second geometric soil mixing plane being distanced from the first geometric soil mixing plane such that the interstitial spaces between the boreholes in the first geometric soil mixing plane and the boreholes in the second geometric soil mixing plane are minimized so that substantially all of the contaminated soil between the boreholes is blended with the chemical hardener.

24. A method for in situ fixation of soil contaminated with toxic wastes using a two-shaft auger apparatus as defined in claim 22, further comprising the steps of sequentially repeating the augering, injecting, blending, withdrawing, and moving steps (a) through (e) in the contaminated soil adjacent the previously augered boreholes to define a second geometric soil mixing plane, said second geometric soil mixing plane being distanced from the first geometric soil mixing plane such that the interstitial spaces between the boreholes in the first geometric soil mixing plane and the boreholes in the second geometric soil mixing plane are minimized so that substantially all of the contaminated soil between the boreholes is blended with the chemical hardener.

25. A method for in situ fixation of soil contaminated with toxic wastes using a two-shaft auger apparatus as defined in claim 17, wherein the chemical hardener injected into the contaminated soil includes a cement product.

26. A method for in situ fixation of soil contaminated with toxic wastes using a two-shaft auger apparatus as defined in claim 23, wherein the chemical hardener injected into the contaminated soil includes a cement product.

27. A method for in situ fixation of soil contaminated with toxic wastes using a two-shaft auger apparatus as defined in claim 24, wherein the chemical hardener injected into the contaminated soil includes a cement product.

28. A method for in situ fixation of soil contaminated with toxic wastes using a two-shaft auger apparatus as defined in claim 25, wherein the chemical hardener injected into the contaminated soil includes bentonite.

29. A method for in situ fixation of soil contaminated with toxic wastes using a two-shaft auger apparatus as defined in claim 26, wherein the chemical hardener injected into the contaminated soil includes bentonite.

30. A method for in situ fixation of soil contaminated with toxic wastes using a two-shaft auger apparatus as defined in claim 27, wherein the chemical hardener injected into the contaminated soil includes bentonite.

31. A method for in situ fixation of soil contaminated with toxic wastes using a two-shaft auger apparatus as defined in claim 25, wherein the boreholes are augered during step (a) to a soil-penetration depth below which the soil is contaminated.

32. A method for in situ fixation of soil contaminated with toxic wastes using a two-shaft auger apparatus as defined in claim 26, wherein the boreholes are augered during step (a) to a soil-penetration depth below which the soil is contaminated.

33. A method for in situ fixation of soil contaminated with toxic wastes using a two-shaft auger apparatus as defined in claim 27, wherein the boreholes are augered during step (a) to a soil-penetration depth below which the soil is contaminated.

34. A method for in situ fixation of soil contaminated with toxic wastes using a three-shaft auger apparatus, the method comprising the steps of:

(a) augering three boreholes downwardly into the contaminated soil with an auger apparatus having three substantially parallel and coplanar shafts, said shafts defining a geometric soil mixing plane, each of the shafts having a penetrating auger at a lower end, means for rotating the shaft at an upper end of the shaft, and a plurality of soil mixing paddles extending outwardly from the shaft and positioned between the upper and lower ends of the shaft;

(b) injecting a chemical hardener into the soil during the augering of the boreholes;

(c) blending the contaminated soil and the chemical hardener in situ with the soil mixing paddles to form a soil/hardener mixture, said blending process minimizing the vertical movement of the contaminated soil out of the boreholes in order to maximize in situ containment of the contaminated soil;

(d) withdrawing the three-shaft auger apparatus from the contaminated soil;

(e) moving the three-shaft auger apparatus to a position such that the shafts are adjacent to previously augered boreholes;

(f) repeating the augering, injecting, blending, withdrawing, and moving steps (a) through (e) in the contaminated soil adjacent to the previously augered boreholes containing the soil/hardener mixture, in a manner such that the interstitial spaces between the adjacent boreholes are minimized and that substantially all of the contaminated soil between the boreholes is blended with the chemical hardener; and (g) allowing the soil/hardener mixture to cure to form a hardened mass in which the contaminated soil is fixated.

35. A method for in situ fixation of soil contaminated with toxic wastes using a three-shaft auger apparatus as defined in claim 34, further comprising the step of cutting the soil with at least two cutting blades attached to the shafts of the three-shaft auger apparatus along planes approximately parallel to the soil mixing plane such that the adjacent boreholes form a single column having a minimum thickness approximately equal to the diameter of the smallest borehole and the interstitial spaces between the adjacent boreholes are minimized.

36. A method for in situ fixation of soil contaminated with toxic wastes using a three-shaft auger apparatus as defined in claim 34, wherein the three-shaft auger apparatus is positioned during the moving step (e) such that one of the shafts of the auger apparatus substantially overlaps a previously augered borehole containing the soil/hardener mixture so that said shaft reaugers said previously augered borehole and the other shafts auger additional boreholes in the contaminated soil.

37. A method for in situ fixation of soil contaminated with toxic wastes using a three-shaft auger apparatus as defined in claim 36, further comprising the step of cutting the soil with at least two cutting blades attached to the shafts of the three-shaft auger apparatus along planes approximately parallel to the soil mixing plane such that the adjacent boreholes form a single column having a minimum thickness approximately equal to the diameter of the smallest borehole and the interstitial spaces between the adjacent boreholes are minimized.

38. A method for in situ fixation of soil contaminated with toxic wastes using a three-shaft auger apparatus as defined in claim 34, wherein first, second, and third boreholes are augered in the contaminated soil during augering step (a) by the first, second, and third shafts of the auger apparatus, respectively; and wherein the first shaft is positioned during moving step (e) such that the first shaft is positioned adjacent the third borehole such that fourth, fifth and sixth boreholes are augered into the soil by the first, second, and third shafts, respectively; and further comprising reaugering the third and fourth boreholes with two of the three shafts such that the first, second, third, fourth, fifth, and sixth boreholes form adjacent boreholes of soil/hardener mixture.

39. A method for in situ fixation of soil contaminated with toxic wastes using a three-shaft auger apparatus as defined in claim 38, further comprising the step of cutting the soil with at least two cutting blades attached to the augers of the three-shaft auger apparatus along planes approximately parallel to the soil mixing plane such that the adjacent boreholes form a single column having a minimum thickness approximately equal to the diameter of the smallest borehole and the interstitial spaces between the adjacent boreholes are minimized.

40. A method for in situ fixation of soil contaminated with toxic wastes using a three-shaft auger apparatus as defined in claim 37, further comprising the steps of sequentially repeating the augering, injecting, blending, withdrawing, and moving steps (a) through (e) in the contaminated soil adjacent the previously augered boreholes to define a second geometric soil mixing plane, said second geometric soil mixing plane being distanced from the first geometric soil mixing plane such that the interstitial spaces between the boreholes in the first geometric soil mixing plane and the boreholes in the second geometric soil mixing plane are minimized so that substantially all of the contaminated soil between the boreholes is blended with the chemical hardener.

41. A method for in situ fixation of soil contaminated with toxic wastes using a three-shaft auger apparatus as defined in claim 39, further comprising the steps of sequentially repeating the augering, injecting, blending, withdrawing, and moving steps (a) through (e) in the contaminated soil adjacent the previously augered boreholes to define a second geometric soil mixing plane, said second geometric soil mixing plane being distanced from the first geometric soil mixing plane such that the interstitial spaces between the boreholes in the first geometric soil mixing plane and the boreholes in the second geometric soil mixing plane are minimized so that substantially all of the contaminated soil between the boreholes is blended with the chemical hardener.

42. A method for in situ fixation of soil contaminated with toxic wastes using a three-shaft auger apparatus as defined in claim 34, wherein the chemical hardener injected into the contaminated soil includes a cement product.

43. A method for in situ fixation of soil contaminated with toxic wastes using a three-shaft auger apparatus as defined in claim 40, wherein the chemical hardener injected into the contaminated soil includes a cement product.

44. A method for in situ fixation of soil contaminated with toxic wastes using a three-shaft auger apparatus as defined in claim 41, wherein the chemical hardener injected into the contaminated soil includes a cement product.

45. A method for in situ fixation of soil contaminated with toxic wastes using a three-shaft auger apparatus as defined in claim 42, wherein the chemical hardener injected into the contaminated soil includes bentonite.

46. A method for in situ fixation of soil contaminated with toxic wastes using a three-shaft auger apparatus as defined in claim 43, wherein the chemical hardener injected into the contaminated soil includes bentonite.

47. A method for in situ fixation of soil contaminated with toxic wastes using a three-shaft auger apparatus as defined in claim 44, wherein the chemical hardener injected into the contaminated soil includes bentonite.

48. A method for in situ fixation of soil contaminated with toxic wastes using a three-shaft auger apparatus as defined in claim 42, wherein the boreholes are augered during step (a) to a soil-penetration depth below which the soil is contaminated.

49. A method for in situ fixation of soil contaminated with toxic wastes using a three-shaft auger apparatus as defined in claim 43, wherein the boreholes are augered during step (a) to a soil-penetration depth below which the soil is contaminated.

50. A method for in situ fixation of soil contaminated with toxic wastes using a three-shaft auger apparatus as defined in claim 44, wherein the boreholes are augered during step (a) to a soil-penetration depth below which the soil is contaminated.

51. A method for in situ fixation of soil contaminated with toxic wastes using a three-shaft auger apparatus as defined in claim 34, wherein the shapes of the boreholes augered by the augers on the three-shaft auger apparatus during step (a) are such that the middle borehole has a diameter smaller than the diameters of the other boreholes and such that there is overlap of the middle borehole with the other boreholes.

52. A method for in situ fixation of soil contaminated with toxic wastes using a three-shaft auger apparatus as defined in claim 36, wherein the shapes of the boreholes augered by the augers on the three-shaft auger apparatus during augering step (a) are such that the middle borehole has a diameter smaller than the diameters of the other boreholes and such that there is overlap of the middle borehole with the other boreholes, thereby minimizing the interstitial spaces between the boreholes so that substantially all of the contaminated soil is blended with the chemical hardener.

53. A method for in situ fixation of soil contaminated with toxic wastes using a three-shaft auger apparatus as defined in claim 38, wherein the shapes of the boreholes augered by the augers on the three-shaft auger apparatus during augering step (a) are such that the middle borehole has a diameter smaller than the diameters of the other boreholes and such that there is overlap of the middle borehole with the other boreholes, thereby minimizing the interstitial spaces between the boreholes so that substantially all of the contaminated soil is blended with the chemical hardener.

54. A method for in situ fixation of soil contaminated with toxic wastes using a three-shaft auger apparatus as defined in claim 34, wherein the shapes of the boreholes augered by the augers on the three-shaft auger apparatus during augering step (a) are such that the middle borehole has a diameter larger than the diameters of the other boreholes and such that there is overlap of the middle borehole with the other borehole.

55. A method for in situ fixation of soil contaminated with toxic wastes using a three-shaft auger apparatus as defined in claim 36, wherein the shapes of the boreholes augered by the augers on the three-shaft auger apparatus during augering step (a) are such that the middle borehole has a diameter larger than the diameters of the other boreholes and such that there is overlap of the middle borehole with the other boreholes, thereby minimizing the interstitial spaces between the boreholes so that substantially all of the contaminated soil is blended with the chemical hardener.

56. A method for in situ fixation of soil contaminated with toxic wastes using a three-shaft auger apparatus as defined in claim 38, wherein the shapes of the boreholes augered by the augers on the three-shaft auger apparatus during augering step (a) are such that the middle borehole has a diameter larger than the diameters of the other boreholes and such that there is overlap of the middle borehole with the other boreholes, thereby minimizing the interstitial spaces between the boreholes so that substantially all of the contaminated soil is blended with the chemical hardener.

* * * * *

UNITED STATES PATENT AND TRADEMARK OFFICE

CERTIFICATE OF CORRECTION

PATENT NO. : 5,013,185

DATED : May 7, 1991

INVENTOR(S) : OSAMU TAKI

It is certified that error appears in the above-identified patent and that said Letters Patent is hereby corrected as shown below:

Abstract, line 21, "diameter" should be --diameters--
Column 1, line 38, "effects" should be --affects--
Column 2, line 14, "avoids" should be --avoid--
Column 3, line 31, "diameter" should be --diameters--
Column 3, line 41, "diameter" should be --diameters--
Column 5, line 56, after "purpose" insert --of--
Column 8, line 33, "hardener," should be --hardener.--
Column 9, line 9, after "and" insert --is--
Column 9, line 20, "romboidal" should be --rhomboidal--
Column 9, line 63, "diameter" should be --diameters--
Column 10, line 9, "augers 64." should be --auger 64.--
Column 10, line 12, "augers 64" should be --auger 64--
Column 10, line 59, "are" should be --is--
Column 10, line 63, "are" should be --is--
Column 12, line 47, "eliminate" should be --eliminates--

Signed and Sealed this

Twenty-seventh Day of April, 1993

*Attest:*

MICHAEL K. KIRK

*Attesting Officer*

*Acting Commissioner of Patents and Trademarks*